US008873776B2

(12) United States Patent
Kim et al.

(10) Patent No.: US 8,873,776 B2
(45) Date of Patent: Oct. 28, 2014

(54) PIEZOELECTRIC SPEAKER

(75) Inventors: Hye-Jin Kim, Daejeon (KR); Woo Seok Yang, Daejeon (KR); Jong Dae Kim, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 490 days.

(21) Appl. No.: 13/289,225

(22) Filed: Nov. 4, 2011

(65) Prior Publication Data

US 2012/0148073 A1 Jun. 14, 2012

(30) Foreign Application Priority Data

Dec. 10, 2010 (KR) ..... 10-2010-0126266

(51) Int. Cl.
*H04R 25/00* (2006.01)

(52) U.S. Cl.
USPC ..... 381/173; 381/190

(58) Field of Classification Search
CPC ..... H04R 1/222; H04R 7/045; H04R 15/00; H04R 17/00; H04R 17/02; H04R 17/005; H04R 19/06; H04R 21/02; H04R 2499/11
USPC ..... 381/173, 190
See application file for complete search history.

(56) References Cited

U.S. PATENT DOCUMENTS

2002/0067840 A1 6/2002 Kobayashi
2003/0099371 A1 * 5/2003 Ogura et al. ..... 381/190

FOREIGN PATENT DOCUMENTS

JP 2004-088733 A 3/2004
JP 2004-147319 A 5/2004
KR 1020030084773 A 11/2003
KR 1020070042756 A 4/2007
KR 1020070111938 A 11/2007
KR 1020080110402 A 12/2008

OTHER PUBLICATIONS

Machine Translation of JP-2004-147319, Hugo, May 20, 2004.*

* cited by examiner

*Primary Examiner* — Brian Ensey

(57) ABSTRACT

Disclosed is a piezoelectric speaker including: a piezoelectric layer that converts electrical signals into oscillation and outputs sound; an electrode that is formed on a top or a bottom of the piezoelectric layer to apply the electrical signals to the piezoelectric layer; an acoustic diaphragm that is made of a hetero material including a first acoustic diaphragm and a second acoustic diaphragm and is attached to the bottom of the piezoelectric layer on which the electrode is formed; and a frame attached in a form enclosing a side of the acoustic diaphragm.

20 Claims, 11 Drawing Sheets

PIEZOELECTRIC SPEAKER

CROSS-REFERENCE TO RELATED APPLICATIONS

This application is based on and claims priority from Korean Patent Application No. 10-2010-0126266, filed on Dec. 10, 2010, with the Korean Intellectual Property Office, the present disclosure of which is incorporated herein in its entirety by reference.

TECHNICAL FIELD

The present disclosure relates to a low frequency reinforced piezoelectric speaker capable of reproducing a low frequency range and improving an output sound pressure, and more particularly, to a low frequency reinforced piezoelectric speaker capable of improving sound quality, obtaining high sound pressure even at a low frequency, and improving sound flatness by using an acoustic diaphragm formed by bonding, coating, or depositing hetero materials.

BACKGROUND

Recently, as slimness of TV products including LED TV, or the like, in addition to a portable terminal such as a mobile phone, a smart phone, a notebook, or the like, is accelerated, a piezoelectric speaker has been in the limelight as alternatives for an existing dynamic speaker using a magnet coil. The piezoelectric speaker may be manufactured thinner and lighter and may consume less power, as compared with the existing dynamic speaker, such that it has emerged as a speaker technology for the future. In particular, as the portable terminal requires to be small, slim, and light, the applications of the piezoelectric speaker have been actively searched.

However, despite the above-mentioned merits, the piezoelectric speaker has difficulty in commercialization because the piezoelectric speaker outputs low sound pressure and is difficult to reproduce low frequency as compared with the dynamic speaker of the related art. An example of the piezoelectric speaker of the related art may include a piezoelectric speaker manufactured by using a piezoelectric oscillator or attaching a piezoelectric disk to a top of a metal diaphragm, a film type piezoelectric speaker such as polyvinylidene fluoride (PVDF), a micro piezoelectric speaker manufactured by using a silicon mechanical electronic micromachined system (MEMS) process, or the like.

As the piezoelectric speaker of the related art, the piezoelectric speaker using the piezoelectric oscillator is manufactured by attaching the piezoelectric oscillator to the outside of an oscillator panel and uses a principle of generating sound by oscillating the oscillation panel by the piezoelectric oscillator. The piezoelectric speaker using the piezoelectric oscillator needs to transfer the oscillation of the piezoelectric material to the oscillator panel via the elastomer for transferring oscillation, thereby requiring very large oscillation of the piezoelectric material and the relatively larger oscillator panel than the piezoelectric oscillator. In addition, in the case of the piezoelectric speaker using the piezoelectric oscillator, unnecessary resonance may occur during the process of transferring oscillation, such that a peak-dip of the output sound pressure may occur and distortion of sound may occur to degrade the sound quality.

As another piezoelectric speaker of the related art, the piezoelectric speaker manufactured by attaching the piezoelectric disk to the top of the metal diaphragm has a structure of bonding the piezoelectric material to the top of an oscillation thin film made of a metal plate or an alloy, or the like, by using a bonding material and uses a principle of reproducing sound by displacing the metal diaphragm through input signals applied to the piezoelectric material. The piezoelectric speaker can be miniaturized and can be driven at low voltage due to the excellent oscillation transferring performance of the metal diaphragm, as compared with the piezoelectric speaker using the piezoelectric oscillator of the related art. However, the piezoelectric speaker using the metal diaphragm has the relatively thicker oscillation thin film than the piezoelectric material, such that the piezoelectric speaker using the metal diaphragm may output low sound pressure and may be difficult to reproduce low frequency. Further, the piezoelectric speaker using the metal diaphragm may have difficulty in reproducing the low frequency of 1 kHz or less due to a very high elastic modulus of metal. In addition, in the case of the oscillation thin film using the existing metal plate, a rich sound field effect may not be implemented well due to a cold and sharp tone of a metal material and unnecessary resonance may occur due to the frame supporting the oscillation thin film to distort sound.

As another piezoelectric speaker of the related art, the film type piezoelectric speaker using the piezoelectric film material uses a principle of forming electrodes on the top and bottom of the metal diaphragm using the piezoelectric film material such as PVDF and applying voltage to the electrodes to generate sound. The film type piezoelectric speaker is manufactured in a structure in which a polymer conductive layer is formed on both sides of the piezoelectric film and electrodes are formed in a form extending along an edge thereof and then, terminals are formed so as to apply voltage to the electrodes. The film type piezoelectric speaker has a low piezoelectric constant of a piezoelectric material to generate a small displacement, such that the film type piezoelectric speaker needs to be manufactured as a large-area piezoelectric speaker and requires a relatively larger oscillation thin film than other speakers of the related art.

The piezoelectric speaker of the related art outputs the lower sound pressure than the dynamic speaker, and in particular, may be very difficult to reproduce the low frequency. In addition, the piezoelectric speaker of the related art has a narrow frequency reproducing band to degrade the sound quality and requires a sufficiently thin or large diaphragm so as to perform the low frequency reproduction, such that the piezoelectric speaker may not be easily miniaturized when considering the high output sound pressure and the low frequency reproduction.

SUMMARY

The present disclosure has been made in an effort to provide a low frequency reinforced piezoelectric speaker capable of improving sound quality, obtaining high sound pressure even at a low frequency, and improving sound flatness by using an acoustic diaphragm formed by bonding, coating, or depositing hetero materials.

An exemplary embodiment of the present disclosure provides a piezoelectric speaker, including: a piezoelectric layer that converts electrical signals into oscillation and outputs sound; an electrode that is formed on a top or a bottom of the piezoelectric layer to apply the electrical signals to the piezoelectric layer; an acoustic diaphragm that is made of a hetero material including a first acoustic diaphragm and a second acoustic diaphragm and is attached to the bottom of the piezoelectric layer on which the electrode is formed; and a frame attached in a form enclosing a side of the acoustic diaphragm.

As set forth above, the present disclosure provides the piezoelectric speaker including the acoustic diaphragm formed by bonding or coating the hetero material, thereby improving the sound quality, obtaining the high output sound pressure even at a low frequency, and improving the sound flatness by using the acoustic diaphragm formed by bonding or coating the hetero materials.

Further, the present disclosure provides the acoustic diaphragm formed by bonding or coating the hetero material and the piezoelectric speaker including the piezoelectric layer asymmetrically and inclinedly attached to the top thereof, thereby improving the low frequency sound pressure and significantly improving the sound quality by reducing the distortion of sound.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

In the following detailed description, reference is made to the accompanying drawing, which form a part hereof. The illustrative embodiments described in the detailed description, drawing, and claims are not meant to be limiting. Other embodiments may be utilized, and other changes may be made, without departing from the spirit or scope of the subject matter presented here.

Figure 1:
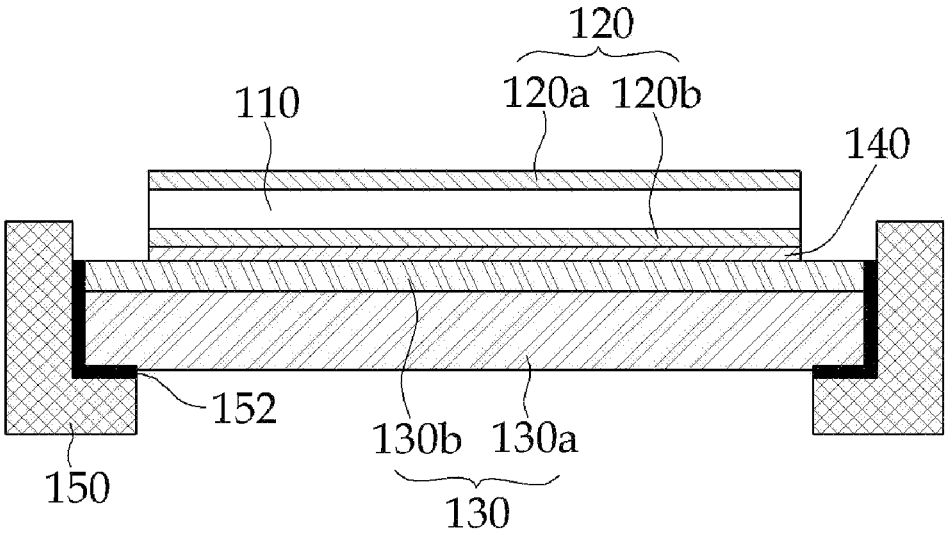
FIGS. 1 and 2 each are a cross-sectional view and a plan view of a piezoelectric speaker according to a first exemplary embodiment of the present disclosure.
Figure 2:
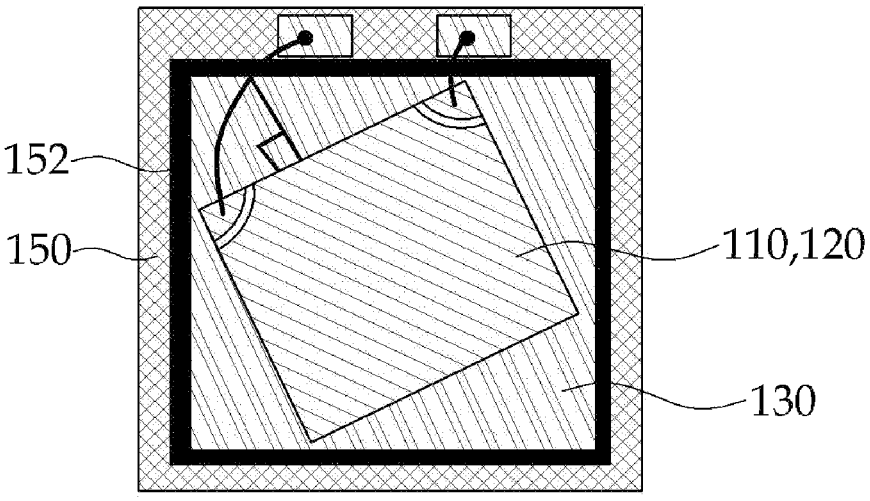

FIGS. 1 and 2 each are a cross-sectional view and a plan view of a piezoelectric speaker according to a first exemplary embodiment of the present disclosure.

Referring to FIGS. 1 and 2, the piezoelectric speaker according to the first exemplary embodiment of the present disclosure includes a piezoelectric layer 110 that is configured as a single-layer thin film or a thin film having a stacked structure, an electrode 120 that is formed on a top of piezoelectric layer 110 or a top and a bottom thereof, an acoustic diaphragm 130 that is attached to piezoelectric layer 110 in an inclined structure or an asymmetric structure and formed by bonding, depositing, or coating hetero materials 130*a* and 130*b*, a high elastic damping material layer 140 that attaches piezoelectric layer 110 to acoustic diaphragm 130, a frame 150 that is attached by a high elastic adhesive 152 in a form enclosing the side of acoustic diaphragm 130, or the like.

Piezoelectric layer 110 converts electrical signals into physical oscillation to output sound and is formed as a thin single-layer thin film by performing a polishing process on a thick film type of a piezoelectric ceramic, or is formed by depositing or coating a thin film having a stacked structure. Piezoelectric layer 110 may include a polycrystalline ceramic such as PZT, a single crystalline piezoelectric material such as PZN-PT, PIN-PT, PYN-PT, or the like, a lead piezoelectric polymer material such as PVDF, PVDF-TrFE, or the like, and a lead-free piezoelectric new material such as BNT ($BaNiTiO_3$), BZT-BCT, or the like. In addition, piezoelectric layer 110 may have various shapes such as a quadrangle, a circle, an oval, a polygonal, or the like.

In addition, piezoelectric layer 110 may be attached to acoustic diaphragm 130 in an inclined structure or any asymmetric structure so as to avoid structural symmetry. In detail, piezoelectric layer 100 may be formed to have an angle of $45<\alpha<90$ degrees with respect to acoustic diaphragm 130. Ideally, piezoelectric layer 110 may have an inclined structure having an angle of 60 to 75 degrees. That is, the structural symmetry of the piezoelectric speaker in all directions needs to be avoided but has an inclined structure so as to make stress at four vertices of frame 150 uniform. This type of inclined structure reduces the distortion of sound and improves the sound quality by preventing the mechanical oscillation generated from piezoelectric layer 110 from forming a standing wave due to frame 150 of the piezoelectric speaker.

Electrode 120 includes a first electrode 120*a* and a second electrode 120*b* and is formed on the top or bottom of piezoelectric layer 110 to electrically open both sides of piezoelectric layer 110, thereby applying electrical signals to piezoelectric layer 110.

As shown in FIG. 2, first electrode 120*a* and second electrode 120*b* are each formed on the top and bottom of piezoelectric layer 110. In this configuration, a positive electrode and a negative electrode may be formed on the top of piezoelectric layer 110 by connecting second electrode 120*b* to a predetermined area on the top of piezoelectric layer 110. In this case, when the positive electrode and the negative electrode are formed on the top of piezoelectric layer 110, the positive electrode and the negative electrode may be electrically opened so as not to short the positive electrode and the negative electrode.

First electrode 120*a* and second electrode 120*b* may be formed in various shapes including a quadrangle, a fan shape, or the like, and are spaced apart from each other by a predetermined interval, such that first electrode 120*a* and second electrode 120*b* may be disposed to be easily soldered when being connected with the external terminal.

In the present disclosure, an interdigitated electrode may be used as electrode 120. As a result, the present disclosure may use a lateral polarization mode of piezoelectric layer 110, make the displacement larger than the top and bottom electrodes, and obtain high sound pressure.

Acoustic diaphragm 130 is formed by bonding, coating, or depositing of hetero material 130 including a first acoustic diaphragm 130*a* and a second acoustic diaphragm 130*b*.

First acoustic diaphragm 130*a* may include a material having low Young's modulus, for example, rubber, silicon, urethane, or the like and may be formed at a thickness of 10 to 300 μm. Therefore, first acoustic diaphragm 130*a* has the lower Young's modulus and the larger oscillation absorption rate than the existing acoustic diaphragm, thereby absorbing the distortion components generated by the oscillation of piezoelectric layer 110 and reducing the distortion of sound.

Second acoustic diaphragm 130*b* may include a material having the Young's modulus 10 times higher than first acoustic diaphragm 130*a*, for example, plastic, metal carbon nanotube (CNT), graphene, or the like, and may be formed at the thickness of 1 to 50 μm. Therefore, second acoustic diaphragm 130*b* may improve the frequency response characteristics of the piezoelectric speaker and may make the characteristics of the output sound pressure uniform up to the high frequency band.

Therefore, the piezoelectric speaker according to the exemplary embodiment of the present disclosure may significantly improve the low frequency range as compared with the existing piezoelectric speaker by the structure of the above-mentioned acoustic diaphragm 130 and may improve the flatness of sound. That is, first acoustic diaphragm 130*a* has the low Young's modulus and is thick to lower the initial resonance frequency, thereby significantly improving the low frequency reproduction and second acoustic diaphragm 130*b* may improve that first acoustic diaphragm 130*a* has large damping and doesn't rapidly transfer sound, thereby improving the frequency response characteristics of the piezoelectric speaker and making the output sound pressure characteristics uniform up to the high frequency band.

Frame 150 is attached using a high elastic epoxy 152 in a form enclosing the side of acoustic diaphragm 130 and may include plastic including poly-butylene terephthalate (PBT), polyacetal (POM), polycarbonate (PC), or the like, or metal or an alloy including aluminum or stainless steel in order to minimize anti-oscillation due to internal loss when acoustic diaphragm 130 is oscillated. In addition, frame 150 may be manufactured at a thickness of 1 mm or less so as to reduce an unnecessary size.

Figure 3:
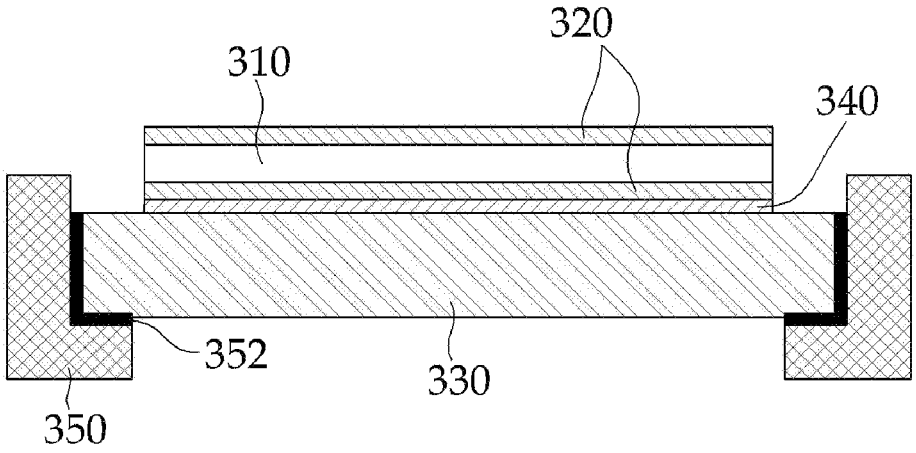
FIGS. 3 and 4 each are a cross-sectional view and a plan view of a piezoelectric speaker according to a second exemplary embodiment of the present disclosure.
Figure 4:
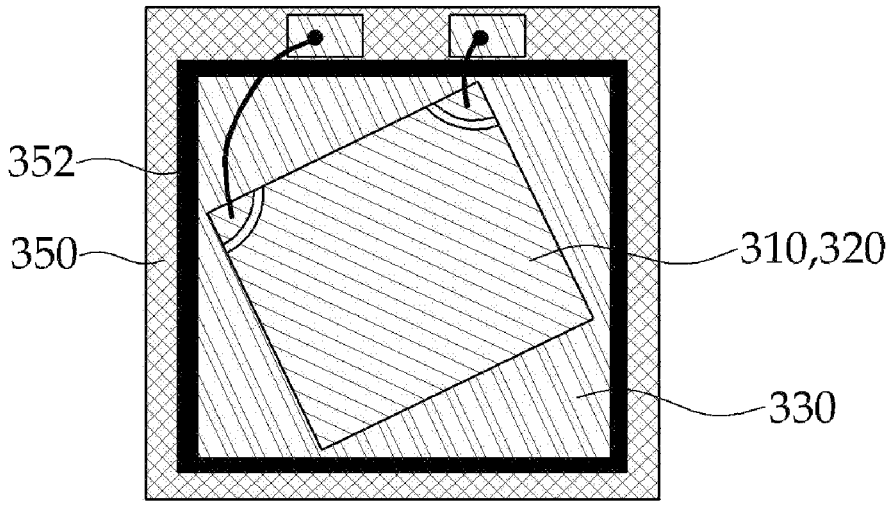

FIGS. 3 and 4 each are a cross-sectional view and a plan view of a piezoelectric speaker according to a second exemplary embodiment of the present disclosure.

Referring to FIGS. 3 and 4, the piezoelectric speaker according to the second exemplary embodiment of the present disclosure has the same structure as the piezoelectric speaker of FIG. 1 but an acoustic diaphragm 330 is configured to have a single structure. That is, acoustic diaphragm 330 of the piezoelectric speaker according to the second exemplary embodiment is made of a nano complex material having a single structure. In this case, the nano complex material is a material obtained by composing polymer such as rubber, silicon, urethane, or the like and a nano structure material such as carbon nanotube (CNT), graphene, or the like Therefore, acoustic diaphragm 330 of the piezoelectric speaker according to the second exemplary embodiment of the present disclosure is inexpensive and may be mass produced while having the same characteristics as acoustic diaphragm 130 formed by bonding, coating, or depositing of the hetero materials in FIG. 1.

Figure 5:
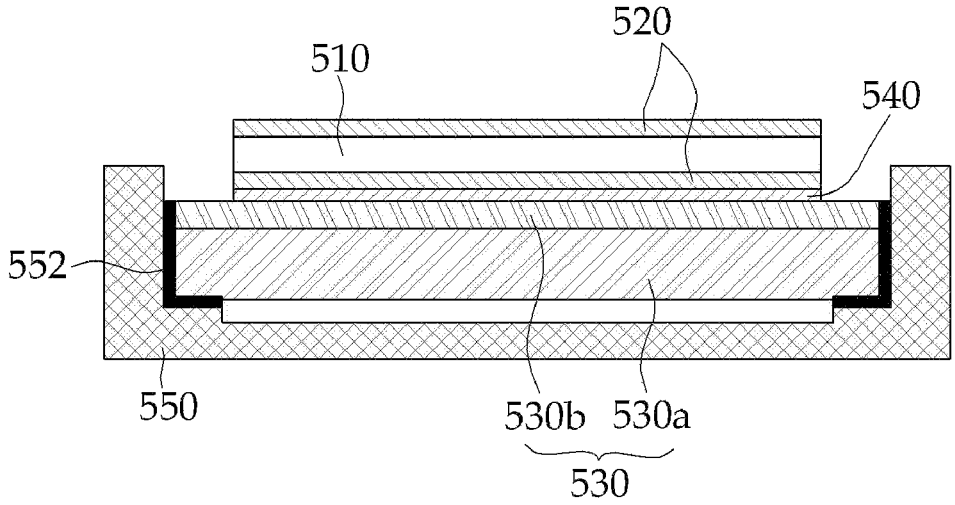
FIG. 5 is a cross-sectional view of a piezoelectric speaker according to a third exemplary embodiment of the present disclosure.

FIG. 5 is a cross-sectional view of a piezoelectric speaker according to a third exemplary embodiment of the present disclosure.

Referring to FIG. 5, the piezoelectric speaker according to the third exemplary embodiment of the present disclosure has the same structure as the piezoelectric speaker of FIG. 1, but has a different frame 550 structure. That is, frame 550 is formed in an enclosure form enclosing the rear radiation of the piezoelectric speaker. The acoustic radiation of the piezoelectric speaker is radiated from the front and the rear thereof at the same sound pressure, such that the output sound pressure from the front thereof may be reduced due to the acoustic radiation from the rear of the piezoelectric speaker. In particular, since the wavelength of the sound wave is long at the low frequency range, the piezoelectric speaker is more affected by the rear acoustic radiation.

Therefore, in the piezoelectric speaker according to the third exemplary embodiment of the present disclosure, frame 550 structure is formed in an enclosure form physically interrupting the acoustic radiation to the rear thereof, thereby significantly improving the output sound pressure of the piezoelectric speaker from the front thereof.

Figure 6:
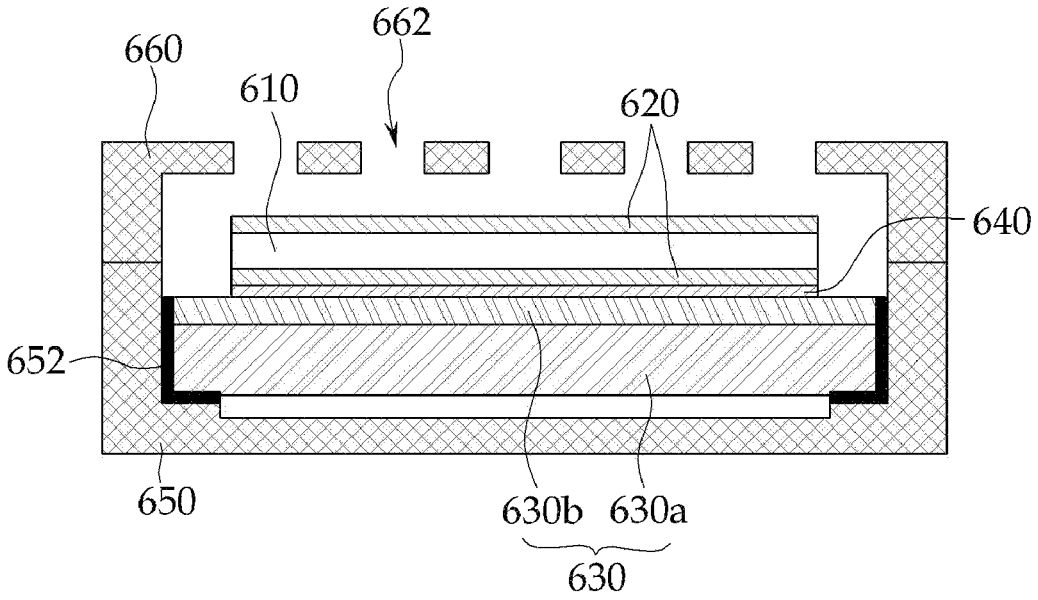
FIG. 6 is a cross-sectional view of a piezoelectric speaker according to a fourth exemplary embodiment of the present disclosure.

FIG. 6 is a cross-sectional view of a piezoelectric speaker according to a fourth exemplary embodiment of the present disclosure.

Figure 7:
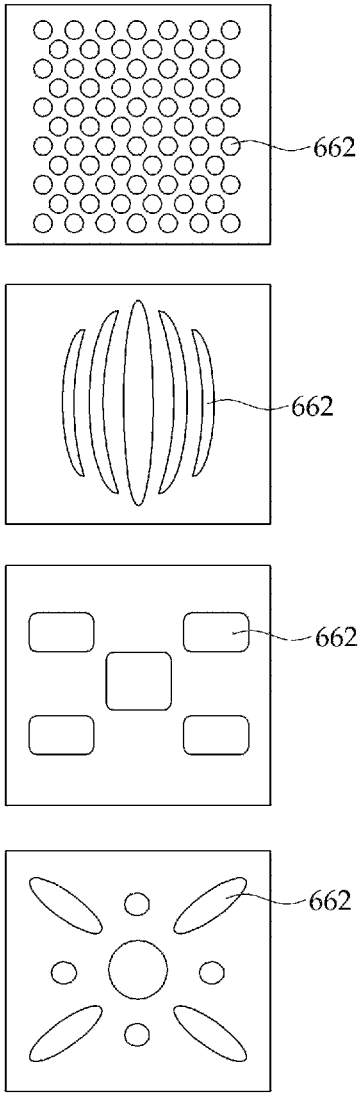
FIG. 7 is a diagram showing various forms of a plurality of acoustic holes formed over a protective cap of a piezoelectric speaker according to a fourth exemplary embodiment of the present disclosure.

Referring to FIG. 6, the piezoelectric speaker according to the fourth exemplary embodiment of the present disclosure includes a frame 650 that interrupts the radiation to the rear thereof, similar to the piezoelectric speaker of FIG. 5. However, the piezoelectric speaker according to the fourth exemplary embodiment of the present disclosure further includes a plurality of acoustic holes 662 formed on the front thereof and a protective cap 660 protecting the piezoelectric speaker without affecting the acoustic radiation to the front thereof. The plurality of acoustic holes 662 at the front of protective cap 660 may be disposed in a circular shape, an oval shape, a polygonal shape, and a radial shape as shown in FIG. 7 and each acoustic hole may be formed in a circular shape, an oval shape, a polygonal shape, or a crescent shape.

In addition, a nonwoven fabric (not shown) protecting the plurality of acoustic holes 662 may be attached to the front of protective cap 660.

Figure 8:
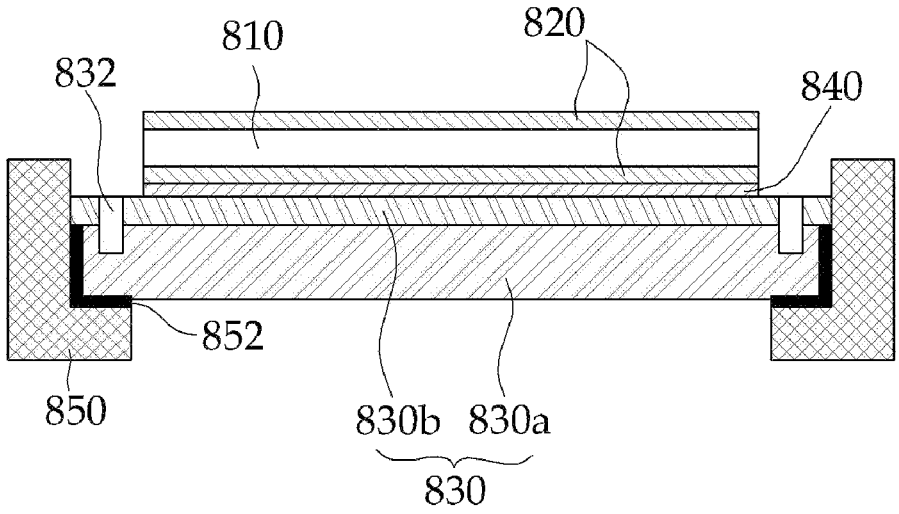
FIGS. 8 and 9 each are a cross-sectional view and a plan view of a piezoelectric speaker according to a fifth exemplary embodiment of the present disclosure.
Figure 9:
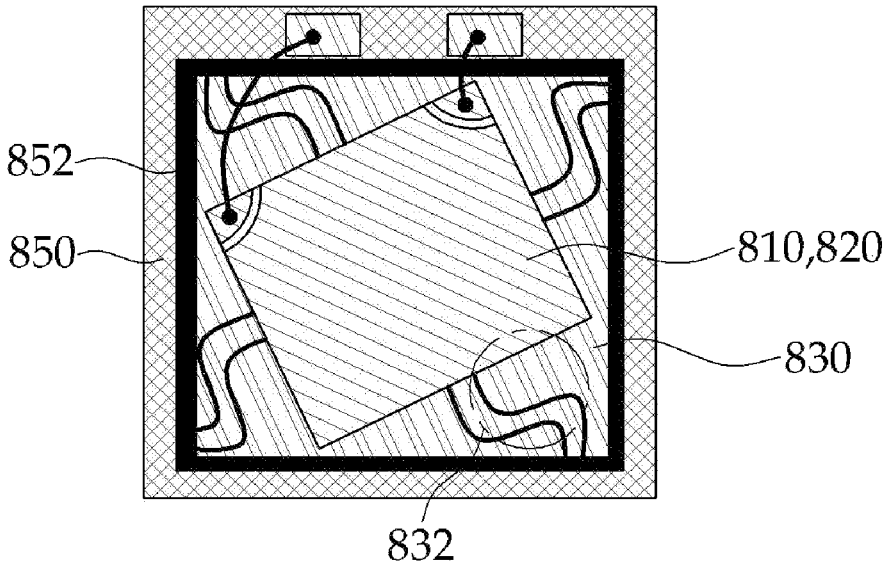

FIGS. 8 and 9 each are a cross-sectional view and a plan view of a piezoelectric speaker according to a fifth exemplary embodiment of the present disclosure.

Referring to FIGS. 8 and 9, the piezoelectric speaker according to the fifth exemplary embodiment of the present disclosure has the same structure as the piezoelectric speaker of FIG. 1 but an acoustic diaphragm 830 is provided with a predetermined pattern of wrinkles 832. In detail, as shown in FIG. 9, the piezoelectric speaker according to the fifth exemplary embodiment of the present disclosure has wrinkles 832 formed on the top surface of acoustic diaphragm 830 other than a surface to which a piezoelectric layer 810 is attached. The wrinkle 832 of the acoustic diaphragm 830 makes the acoustic diaphragm 830 more flexible than the existing flat type acoustic diaphragm to improve the reproduction characteristics at the low frequency and suppresses the division oscillation of the acoustic diaphragm 830 to protect the acoustic diaphragm 830 so as not to be warped according to the oscillation.

Figure 10:
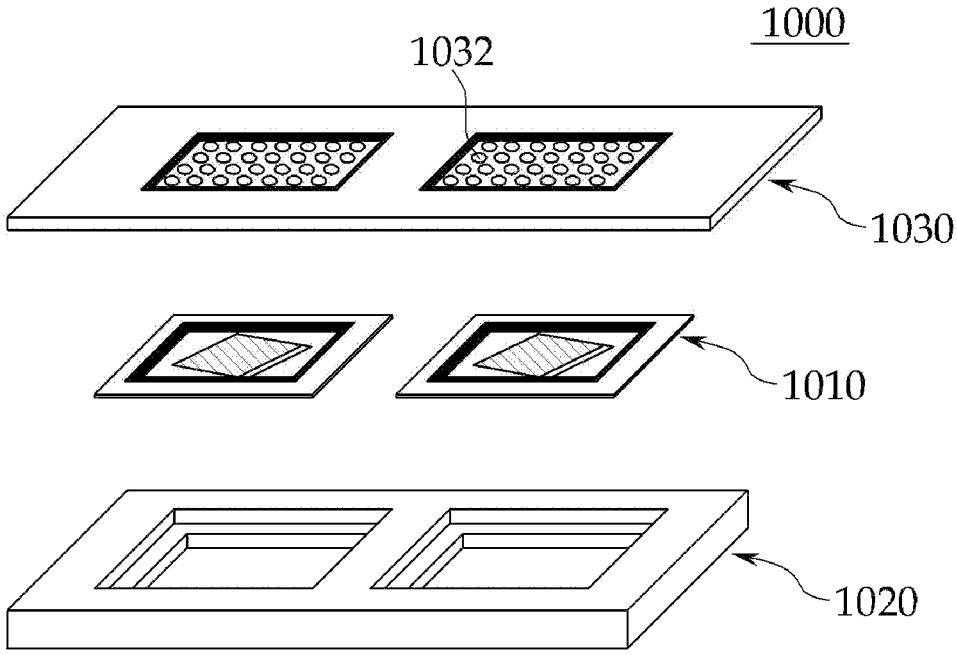
FIG. 10 is an exploded perspective view of a speaker array including a piezoelectric speaker according to an exemplary embodiment of the present disclosure.

FIG. 10 is an exploded perspective view of a speaker array including a piezoelectric speaker according to an exemplary embodiment of the present disclosure.

The piezoelectric speaker according to the exemplary embodiment of the present disclosure may be mounted on a speaker array 1000 as shown in FIG. 10.

Referring to FIG. 10, a piezoelectric speaker 1010 is attached to a frame 1020 using epoxy and a cap 1030 including a nonwoven fabric (not shown) for protecting the front of piezoelectric speaker 1010 or including a front acoustic hole 1032 is attached to the top of frame 1020 including piezoelectric speaker 1010. In the configuration of speaker array 1000, since frame 1020 increases the internal loss, there is a need to minimize the anti-oscillation due to the oscillation of piezoelectric speaker 1010. In addition, frame 1020 of speaker array 1000 may be designed to include the enclosure of individual speakers.

As shown in FIG. 10, speaker array 1000 may be configured to house two piezoelectric speakers and speaker array 1000 may be configured to include at least two linear arrays and a plurality of speaker surface type arrays.

Figure 11:
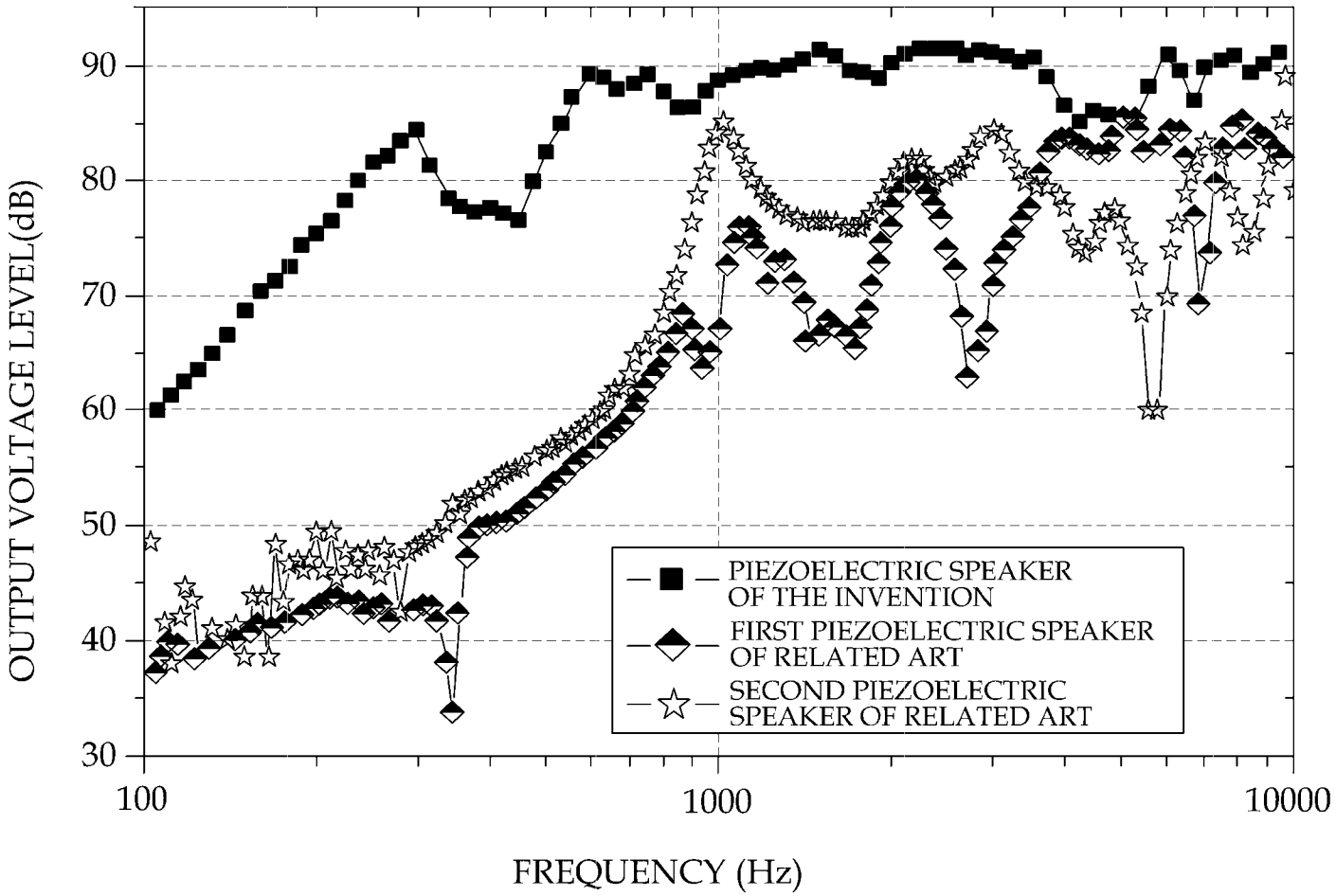
FIG. 11 is a graph showing output sound pressure characteristics of the piezoelectric speaker according to an exemplary embodiment of the present disclosure.

FIG. 11 is a graph showing output sound pressure characteristics of the piezoelectric speaker according to an exemplary embodiment of the present disclosure.

Referring to FIG. 11, when comparing the output sound pressure (-■-) of the piezoelectric speaker according to the exemplary embodiment of the present disclosure with the output sound pressure (-◆-, -★-) of the commercial piezoelectric speaker of the related art, the piezoelectric speaker according to the exemplary embodiment of the present disclosure shows the higher output sound pressure than the output sound pressure from the commercial piezoelectric speaker of the related art. In particular, it can be confirmed that the piezoelectric speaker according to the exemplary embodiment of the present disclosure can considerably enhance the output sound pressure at the low frequency range. That is, the piezoelectric speaker according to the exemplary embodiment of the present disclosure may reproduce well the low frequency that is not likely to be implemented by the commercial piezoelectric speaker of the related art and may obtain the higher output sound pressure at a broader frequency band through the acoustic diaphragm made of the hetero material, as compared with the related art.

In addition, the general piezoelectric speaker may obtain the larger output sound pressure as the size of the acoustic diaphragm is increased. Therefore, if the size of the piezoelectric speaker according to the exemplary embodiment of the present disclosure is increased, it is apparent that the piezoelectric speaker of the present disclosure may obtain the larger output sound pressure and the low frequency characteristics as compared with the existing piezoelectric speaker. Therefore, the piezoelectric speaker according to the exemplary embodiment of the present disclosure is miniaturized, but may further improve the output sound pressure characteristics and significantly improve the bass output, as compared with the piezoelectric speaker of the related art.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A piezoelectric speaker, comprising:

a piezoelectric layer that converts electrical signals into oscillation of the piezoelectric layer and outputs sound;

an electrode that is disposed on a top surface or a bottom surface of the piezoelectric layer to apply the electrical signals to the piezoelectric layer;

an acoustic diaphragm that is made of a hetero material including a first acoustic diaphragm and a second acoustic diaphragm and disposed under the bottom surface of the piezoelectric layer; and a frame that is attached to the acoustic diaphragm to enclose a side of the acoustic diaphragm, wherein a Young's modulus of the first acoustic diaphragm is lower than a Young's modulus of the second acoustic diaphragm.

2. The piezoelectric speaker of claim 1, wherein the piezoelectric layer is configured as a single-layer thin film or a thin film having a stacked structure.

3. The piezoelectric speaker of claim 1, wherein the piezoelectric layer includes at least one of PZT, PMN-PT, PZN-PT, PIN-PT, PYN-PT, PVDF, PVDF-TrFE, BNT ($BaNiTiO_3$), and BZT-BeT.

4. The piezoelectric speaker of claim 1, wherein the piezoelectric layer is formed in anyone of a polygonal shape, a circular shape, and an oval shape.

5. The piezoelectric speaker of claim 1, wherein the piezoelectric layer is disposed on the top surface of the acoustic diaphragm and is canted asymmetrically with respect to the acoustic diaphragm.

6. The piezoelectric speaker of claim 1, wherein the first acoustic diaphragm includes at least one of rubber, silicon, and urethane.

7. The piezoelectric speaker of claim 1, wherein the second acoustic diaphragm includes at least one of plastic, metal, carbon nanotube CCNT), and graphene.

8. The piezoelectric speaker of claim 1, wherein the hetero material is formed by using anyone of bonding, coating, and depositing methods.

9. The piezoelectric speaker of claim 1, wherein the acoustic diaphragm uses a nano complex material instead of the hetero material.

10. The piezoelectric speaker of claim 9, wherein the nano complex material is formed by composing a polymer including at least one of rubber, silicon, and urethane and a nano structure material including carbon nanotube CCNT) or graphene.

11. The piezoelectric speaker of claim 1, wherein a remaining portion of the top surface of the acoustic diaphragm other than a portion of the top surface of the acoustic diaphragm to which the piezoelectric layer is attached includes a wrinkle.

12. The piezoelectric speaker of claim 1, wherein the frame is configured in an enclosure form enclosing acoustic radiation from a rear of the acoustic diaphragm and forms a predetermined space by being spaced apart from a bottom surface of the acoustic diaphragm.

13. The piezoelectric speaker of claim 1, wherein the frame is made of plastic including at least one of poly-butylene terephthalate (PBT), polyacetal (POM), and polycarbonate (PC) or metal or an alloy including aluminum or stainless steel.

14. The piezoelectric speaker of claim 1, further comprising a high elastic damping material layer that bonds the piezoelectric layer to the acoustic diaphragm.

15. The piezoelectric speaker of claim 14, wherein the damping material layer includes at least one of rubber, silicon, and urethane.

16. The piezoelectric speaker of claim 1, further comprising a protective cap that has a plurality of acoustic holes formed on the front thereof and houses the front of the piezoelectric speaker.

17. The piezoelectric speaker of claim 16, wherein the plurality of acoustic holes are disposed in anyone of a circular shape, an oval shape, a polygonal shape, and a radial shape.

18. The piezoelectric speaker of claim 16, wherein the protective cap further includes a nonwoven fabric protecting the plurality of acoustic holes formed on the front thereon.

19. A piezoelectric speaker, comprising:

a piezoelectric layer that converts electrical signals into oscillation of the piezoelectric layer and outputs sound;

an electrode that is disposed on a top surface or a bottom surface of the piezoelectric layer to apply the electrical signals to the piezoelectric layer;

an acoustic diaphragm that is made of a hetero material including a first acoustic diaphragm and a second acoustic diaphragm and disposed under the bottom surface of the piezoelectric layer; and a frame that is attached to the acoustic diaphragm to enclose a side of the acoustic diaphragm; and a high elastic damping material layer that bonds the piezoelectric layer to the acoustic diaphragm.

20. A piezoelectric speaker, comprising:

a piezoelectric layer that converts electrical signals into oscillation of the piezoelectric layer and outputs sound;

an electrode that is disposed on a top surface or a bottom surface of the piezoelectric layer to apply the electrical signals to the piezoelectric layer;

an acoustic diaphragm that is made of a nano complex material including a first acoustic diaphragm and a second acoustic diaphragm and disposed under the bottom surface of the piezoelectric layer; and a frame that is attached to the acoustic diaphragm to enclose a side of the acoustic diaphragm.

* * * * *